United States Patent [19]

Ammon

[11] Patent Number: 4,886,202

[45] Date of Patent: Dec. 12, 1989

[54] METHOD OF MAKING METAL MATRIX MONOTAPE RIBBON AND COMPOSITE COMPONENTS OF IRREGULAR SHAPE

[75] Inventor: Robert L. Ammon, Baldwin Borough, Pa.

[73] Assignee: Westinghouse Electric Corp., Pittsburgh, Pa.

[21] Appl. No.: 268,145

[22] Filed: Nov. 7, 1988

[51] Int. Cl.[4] ..... B23K 9/00; B23K 9/04; B05D 1/02; C23C 7/00

[52] U.S. Cl. ..... 228/120; 228/121; 228/190; 228/261; 228/263.12; 164/46; 164/97; 219/76.13; 219/76.14; 219/121.47; 416/230; 427/37; 427/178; 427/423

[58] Field of Search ..... 228/120, 121, 190, 261, 228/263.12; 164/46, 97; 219/76.13, 76.14, 121.47; 416/230 R, 230 A; 427/37, 178, 423

[56] References Cited

U.S. PATENT DOCUMENTS

| | | | |
|---|---|---|---|
| 2,951,003 | 8/1968 | Stephens . | |
| 3,092,533 | 6/1963 | Beckner . | |
| 3,427,185 | 2/1969 | Cheatham et al. . | |
| 3,476,635 | 11/1969 | Heh . | |
| 3,526,557 | 9/1970 | Taylor . | |
| 3,553,045 | 1/1971 | Heh . | |
| 3,784,428 | 1/1974 | Willats et al. . | |
| 3,873,291 | 3/1975 | Miller . | |
| 4,247,258 | 1/1981 | Griffe, Jr. et al. | 416/230 A |
| 4,264,278 | 4/1981 | Weingart | 416/230 A |
| 4,381,960 | 5/1983 | Pinter et al. | 416/230 R |
| 4,518,625 | 5/1985 | Westfall | 427/37 |

*Primary Examiner*—Richard K. Seidel
*Assistant Examiner*—Samuel Heinrich
*Attorney, Agent, or Firm*—Fred J. Baehr, Jr.

[57] ABSTRACT

A method of fabricating irregular shapes wrapped with metal matrix composite monotape utilizing a cylindrical deposition drum wrapped with a spiraling array of evenly spaced strands of high strength fibers and overlaid with a metal matrix, which is cut into a narrow ribbon which is transferred to a spool and then wound on the irregular shape in a helical manner so that the opposite side margins are adjacent each other in adjacent turns.

8 Claims, 3 Drawing Sheets

METHOD OF MAKING METAL MATRIX MONOTAPE RIBBON AND COMPOSITE COMPONENTS OF IRREGULAR SHAPE

BACKGROUND OF THE INVENTION

The invention relates to a method of making metal matrix composite monotape ribbon and more particularly to a method of using metal matrix composite monotape ribbons for making irregular shaped composite components.

U.S. Pat. No. 4,518,625 describes a process for utilizing metal arc spraying to spray liquid metal onto an array of high strength fibers that have been previously wound onto a large drum contained inside a controlled atmosphere chamber. The chamber is first evacuated to remove gaseous contaminants and then back filled with a neutral gas up to atmospheric pressure. This process is used to produce large size metal matrix composite monotape. When making composite components from conventional monotape, it is difficult to circumferentially apply the monotape to an irregularly shaped mandrel, particularly when the component diameter changes significantly along its axis of rotation producing surfaces with widely varying slopes. This difficulty must be circumvented to produce high quality irregular shaped composite components.

SUMMARY OF THE INVENTION

Among the objects of the invention may be noted the provision of monotapes with arrays of evenly spaced fibers even though utilized on irregular shapes with a plurality of different slopes.

In general, a method of fabricating irregular shapes wrapped with metal matrix composite monotape, when made in accordance with this invention, comprises the steps of: wrapping a cylindrical drum with an array of fibers disposed on a predetermined pitch so as to form a spiraling path in which each wrap of the array is disposed on the drum adjacent the previous wrap; overlaying the fiber wrapped cylindrical drum with molten metal utilizing an arc spray: cutting the solidified overlay following a spiraling path so as not to cut any of the fibers; removing the cut overlay from the cylindrical drum in the form of a long metal matrix composite monotape with generally parallel side margins; and wrapping the irregular shape with the monotape in a spiral configuration so that the side margin of one wrap is adjacent the opposite side margin of the adjacent wrap.

BRIEF DESCRIPTION OF THE DRAWINGS

The invention as set forth in the claims will become more apparent by reading the following detailed description in conjunction with the accompanying drawings, wherein like reference numerals refer to like parts through the drawings and in which:

DESCRIPTION OF THE PREFERRED EMBODIMENT

Figure 1:
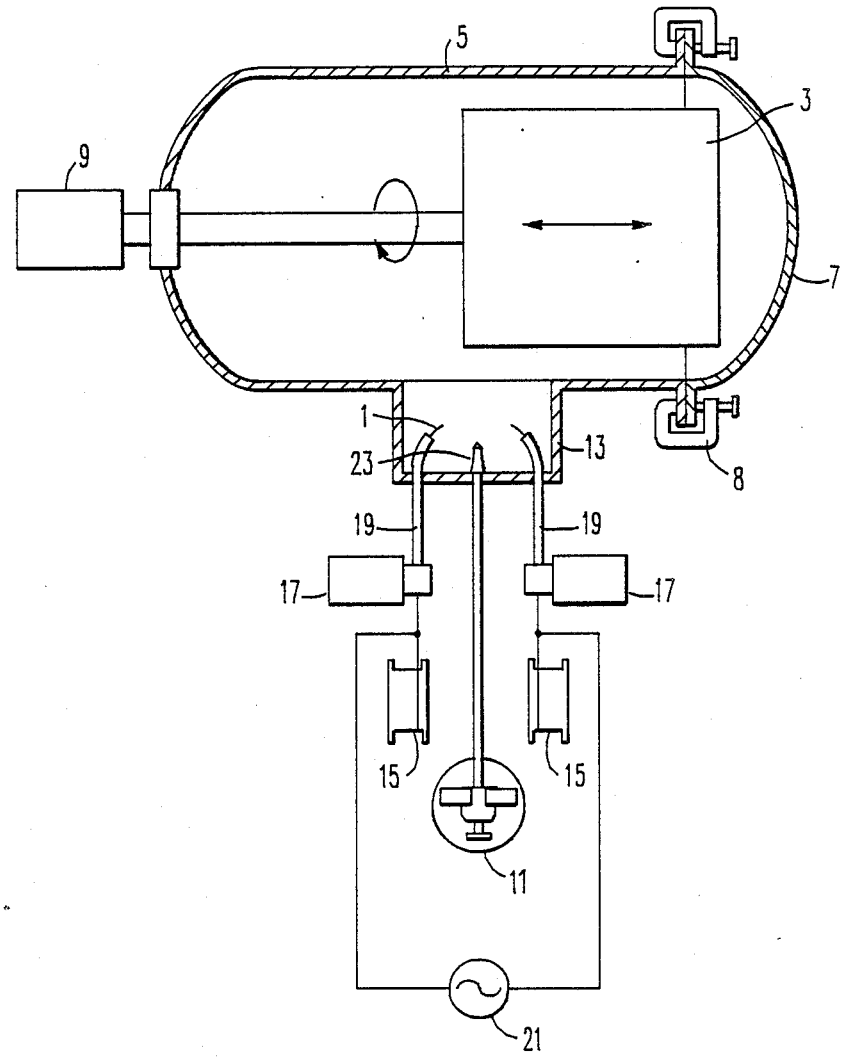
FIG. 1 is a schematic drawing showing arc spray apparatus utilized to perform the invention.

Referring now to the drawings in detail and in particular to FIG. 1 there is shown a schematic of apparatus utilized in an arc spray process, which deposits spray from wires 1 melted by an arc onto a deposition drum 3. The deposition drum 3 is disposed in a vessel 5 having a head 7 sealably affixed to the vessel by hinged C-clamps 8. The drum 3 is removably attached to a drive mechanism 9, which rotates the drum 3 and moves it axially within the vessel 5. A vacuum pump (not shown) is used to evacuate the vessel 3 prior to filling it with inert gas supplied from a tank 11. An arc spray chamber 13 is disposed on one side of the vessel 5 and opens thereto. A pair of wire feeding devices comprising a pair of spools 15 containing the desired wire, a pair of variable speed independently controlled wire drive mechanisms 17 and a pair of wire tubes 19 cooperate to feed two wires 1 into the arc spray chamber 13 so that the distal ends of the wires 1 move toward each other at a controlled rate. A DC or AC power supply 21 is connected to the wires 1 to apply a sufficiently high voltage to the wires to produce an arc between the distal ends of the wires 1 causing the distal ends to melt. Inert gas from the tank 11 is feed through a nozzle 23 to produce a high velocity stream which blows a stream of molten metal from the distal ends of the wire 1 toward the deposition drum 3. The deposition drum 3 is preferably made of a material having high thermal conductivity such as aluminum and is generally cylindrical with an outer peripheral surface having a finish the roughness of which is tailored depending on the overlay being formed thereon. When overlays in the form of metal matrix monotapes are being produced a surface roughness with a root mean square, rms, value of 16 or less is preferred.

Figure 2:
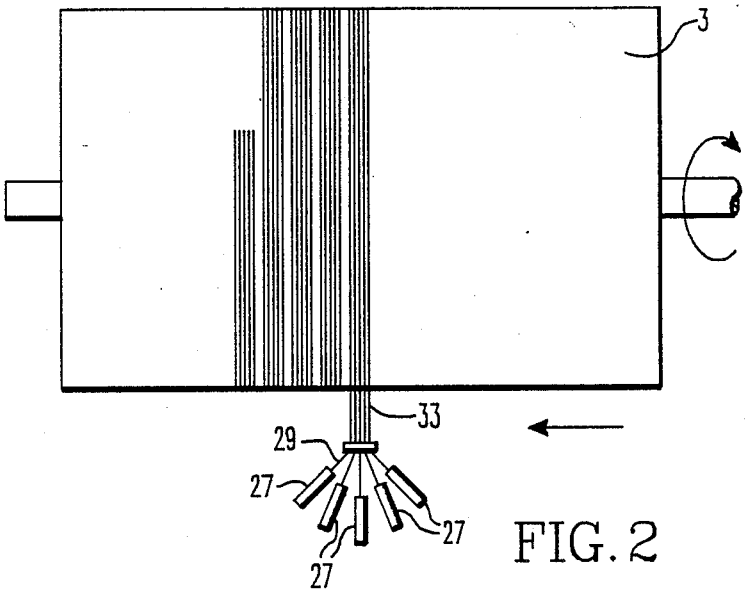
FIG. 2 is a schematic view of an array of fibers being wrapped on a deposition drum.

As shown in FIG. 2 the cylindrical deposition drum 3 has disposed adjacent thereto a plurality of spools 27 each of which is wound with a continuous filament 29 of high strength fiber. The filaments 29 from the spools are feed through a card disposed between the deposition drum 3 and the spools 27 to a fastening jig (not shown) which attaches to each of the filaments 29 to the deposition drum 3 in order to provide the proper spacing between the filaments 29 forming the array 33 of evenly spaced filaments 29. The array 33 of evenly spaced continuous filaments 29 of high strength fibers is wrapped in a helical wrap with such a pitch that after each revolution of the drum 3 the array 33 being wound on the drum 3 is adjacent the array 33 previously wound on the drum 3. Since the deposition drum 3 is cylindrical in shape the spacing between the filaments 29 and between the wound arrays are maintained over the entire outer surface of the drum 3 during the winding process. At the end of the spiral array as at the beginning the filaments 29 are fastened to a fastening jig (not shown) which fasten the filaments 29 to the drum 3 and to cooperate with the card 31 and cylindrical surface on the deposition drum 3 to establish and maintain the even spacing of the filaments 29 in the array 33 and between the wound arrays 33. The spiral wound arrays 33 of filaments 29 are then overlaid with a metal matrix utilizing an arc spray.

Figure 3:
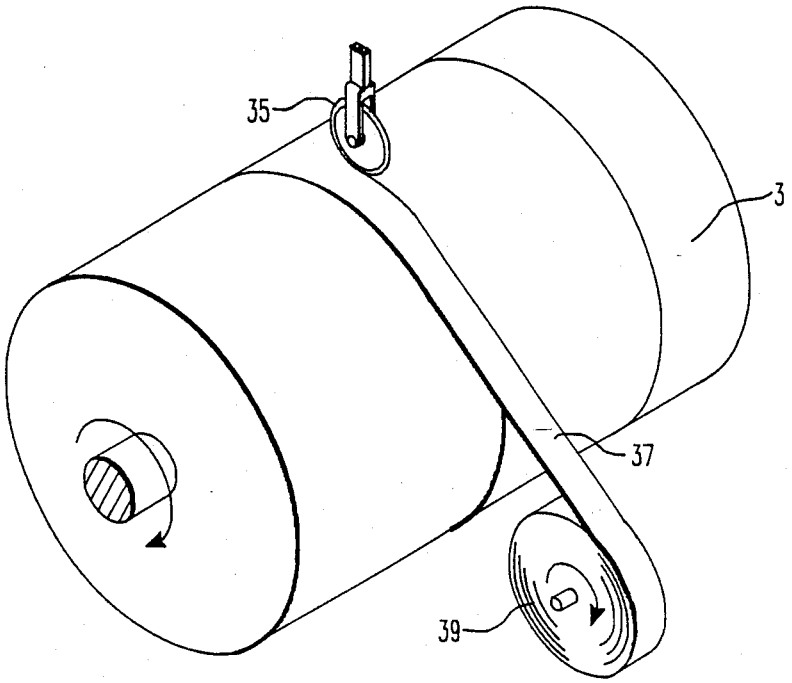
FIG. 3 is a schematic view of a monotape being sliced and formed into a ribbon which is being wrapped on a spool.

FIG. 3 shows the deposition drum 3 with a rotating cutter 35 adapted to cut the metal matrix between the helical disposed spiral wound arrays 33 of reinforcement filaments 29 without cutting any of the filaments 29 to form a ribbon 37 having evenly spaced longitudinally disposed continuous filaments 29 with generally parallel side margins. The ribbon 37 is cut to a width tailored to the abruptness of the change in slope of the irregular shape 41 and then wound onto a spool 39.

Figure 4:
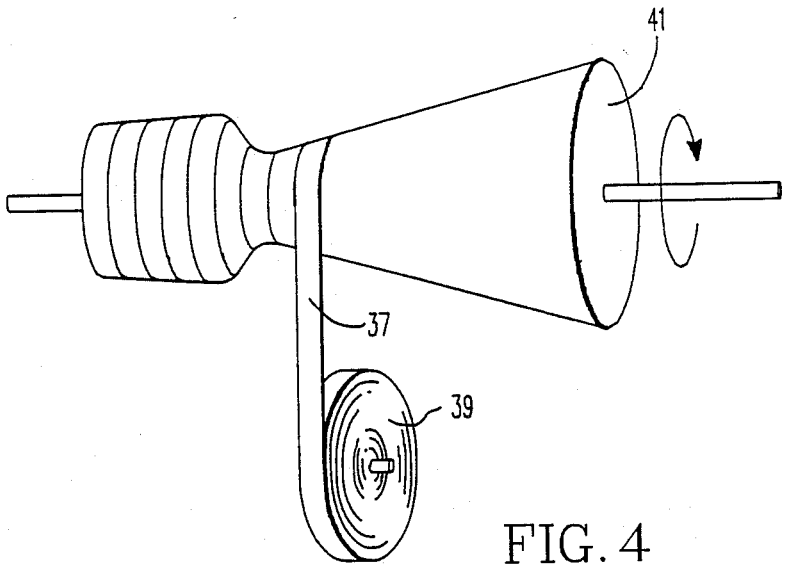
FIG. 4 is a schematic view of a monotape being wrapped on an irregular shaped mandrel.

As shown in FIG. 4 an irregular shape or surface 41 with a myriad of abruptly changing slopes and with at least one portion thereof having an elliptical cross section is wrapped with the ribbon 37 of monotape fed from the spool 39 disposed adjacent thereto. In the embodiment shown, the ribbon 39 is wound in a spiral configuration so that the side margin of one wrap is adjacent the opposite side margin of the adjacent wrap and so that the side margins of one wrap abut the opposite side margin of the adjacent wrap. Of course it is understood that the irregular surface 41 could be wrapped in such a manner that an applied wrap overlaps a previously applied wrap by generally 50% of the width of the ribbon 37 to generally provide a double wrap. Alternately a double wrap could be formed by starting one wrap on one end of the irregular surface 41 forming a first layer of ribbon 37 and starting the second wrap on the opposite end of the irregular surface 41 forming a second layer of ribbon 37 so that the two layers of ribbon 37 spiral in different directions. The ribbons 37 can be affixed to the irregular surface 41 by welding, by isopressing or other densifying means, by overlaying with metal from an arc spray or by other means. The width of the ribbon 37 and the spacing and number of filaments 29 in the array 33 are tailored to provide the proper design strength and to provide proper layering of the ribbon 37 on the specific configuration of the irregular surface 41.

The method of operating this metal spray apparatus to form a ribbon having continuous filaments disposed on a predetermined pitch for wrapping irregular shaped surfaces is as follows:

The spools 15 are wrapped with wire 1, the wire 1 may be any metal or metal alloy. The same or different wires can be wrapped on each spool 15 depending on the desired properties of the matrix to be formed. The cylindrical deposition drum 3 made from a material with a high thermal conductivity, such as aluminum and having a outer peripheral surface finish tailored to the overlay, is sprayed with a commercially available mold release agent. The cylindrical drum 3 is then overlaid with an array 33 of evenly spaced continuous filaments 29 of high strength fibers such as tungsten alloy, silicon carbide or any other fiber. The spacing between the filaments 29 or pitch and the quantity of fibers disposed therein depend on the shape of the irregular surface 41 and mechanical design criteria such as operating temperature and pressure. The drum 3 with the array 33 helically wrapped thereon is connected to the drive mechanism 9, which is adapted to rotate the deposition drum 3 and moves it axially. The vessel 5 is closed, sealed, purged, evacuated and filled with an inert gas such as argon. The wire 1 from the spools 15 is feed through the wire drives 17 and wire tubes 19 into the spray chamber 13. Inert gas is supplied through the nozzle 23. The drum drive mechanism 9 rotates and moves the drum 3 axially causing the spray stream of molten metal to trace a spiral path over the outer surface of the deposition drum 3. Typically the drum 3 is rotated about 60 rpm and moves axially at about 60 inches a minute. While this is the preferred operation it is understood that the movement of the drum 3 could combine slow rotation and rapid axial reciprocation. As the distal ends of the wires 1 approach each other an arc is formed creating sufficient heat to melt the distal ends of the wires 1. The inert gas flowing through the nozzle 23 at high velocity disbursing the molten wire 1 in a molten stream toward the deposition drum 3 upon which it collects and solidifies overlaying the array 33 of high strength fibers 29 disposed on the deposition drum 3 to form a fiber reinforced metal matrix composite.

As shown in FIG. 3 a rotating cutter or other means for cutting the metal matrix is adapted to cut the metal matrix composite following a spiraling path through the metal matrix so as not to cut any of the filaments 29 and form the ribbon 37 with generally parallel side margins. The ribbon 37 is then wound on the spool 39 as it is cut.

FIG. 4 shows the ribbon 37 from the spool 39 being wound on the irregular surface 41 so that opposite side margins of the ribbon are adjacent each other in successive wraps. The adjacent margins may abut or they may overlap for example 50% to form a double wrap. Double wraps can also be formed by wrapping the irregular surface 41 starting at one end and wrapping the ribbon so that opposite side margins of the ribbon 37 abut to complete the first spiral wrap or layer and then starting the second complete spiral wrap or layer of ribbon 37 from the opposite end and also wrapping the ribbon 37 forming the second wrap so that opposite side margins of the ribbon 37 abut. Thus, each completed spiral wrap or layer of ribbon 37 spirals in a different direction. The ribbon 37 has a width tailored to provide a smooth wrap with the reinforcing filaments 29 maintained with a predetermined spacing therebetween irrespective of the various slopes and their changes of direction. The ribbon is narrower when the irregular shape 41 has an abrupt change in slope and wider when all of the changes in slope of the irregular shape 41 are more gradual. The spiral wrap is affixed to the irregular shape 41 by welding, by isopressing or other densifying means, by overlaying with metal from an arc spray or by other means.

While the preferred embodiments described herein sets forth the best mode to practice this invention presently contemplated by the inventor, numerous modifications and adaptations of this invention will be apparent to others skilled in the art. Therefore, the embodiments are to be considered as illustrative and exemplary and it is understood that numerous modifications and adaptations of the invention as described in the claims will be apparent to those skilled in the art. Thus, the claims are intended to cover such modifications and adaptations as they are considered to be within the spirit and scope of the invention.

What is claimed is:

1. A method of fabricating irregular shapes wrapped with metal matrix composite monotape comprising the steps of:

wrapping a cylindrical drum with an array of fibers disposed on a predetermined pitch so as to form a spiraling path in which each wrap of the array is disposed on the drum adjacent the previous wrap;

overlaying the fiber wrapped cylindrical drum with molten metal utilizing an arc spray;

cutting the solidified overlay following a spiraling path so as not to cut any of the fibers;

removing the cut overlay from the cylindrical drum in the form of a ribbon of metal matrix composite monotape with generally parallel side margins; and wrapping the irregular shape with the ribbon in a spiral configuration so that the side margin of one wrap is adjacent the opposite side margin of the adjacent wrap.

2. The method of claim 1, wherein the step of removing the ribbon from the cylindrical drum comprises wrapping the ribbon on a spool.

3. The method of claim 1 and further comprising the step of densifying the ribbon on the irregular shape.

4. The method of claim 1 and further comprising the step of overlaying the ribbon disposed on the irregular shape with molten metal utilizing an arc spray to affix the monotape on the irregular shape.

5. The method of claim 1, wherein the step of wrapping the irregular shape with the monotape comprises overlapping the tape generally 50% of its width.

6. The method of claim 1, wherein the step of wrapping the irregular shape with the ribbon comprises wrapping the ribbon so that the side margin of one wrap abut the opposite side margin of the adjacent wrap.

7. The method of claim 1, wherein the step of wrapping the irregular shape with the ribbon comprises wrapping the irregular shape with a first layer of ribbon in a spiral so that the side margins of one wrap abut the opposite side margins of the adjacent wrap starting on one end of the irregular shape and starting on the opposite end with the second layer by wrapping the ribbon in a spiral so that the side margins of one wrap abut the opposite side margins of the adjacent wrap so that the two layers spiral in opposite directions.

8. The method of claim 1 and further comprising the step of providing narrow ribbon when the irregular shape has abrupt changes in slope and providing a wide ribbon when the irregular shape has gradual changes in slope.

* * * * *